United States Patent [19]

Wilson

[11] Patent Number: 4,907,983

[45] **Date of Patent: * Mar. 13, 1990**

[54] ELECTRICAL CONNECTOR

[75] Inventor: Ronald A. Wilson, Medway, Mass.

[73] Assignee: Microwave Development Laboratories, Needham, Mass.

[ * ] Notice: The portion of the term of this patent subsequent to Oct. 4, 2005 has been disclaimed.

[21] Appl. No.: 183,974

[22] Filed: Apr. 20, 1988

Related U.S. Application Data

[63] Continuation-in-part of Ser. No. 864,739, May 13, 1986, Pat. No. 4,775,325, which is a continuation of Ser. No. 729,642, May 2, 1985, abandoned, which is a continuation-in-part of Ser. No. 610,268, May 14, 1984, abandoned, which is a continuation-in-part of Ser. No. 579,404, Feb. 13, 1984, abandoned.

[51] Int. Cl.[4] ..... H01R 13/405; H01R 17/04

[52] U.S. Cl. ..... 439/278; 439/675; 439/578; 439/736

[58] Field of Search ..... 439/271–282, 439/578–585, 587–589, 675, 736, 869

[56] References Cited

U.S. PATENT DOCUMENTS

| | | | |
|---|---|---|---|
| 2,590,761 | 3/1952 | Edgar | 308/237 |
| 2,984,811 | 5/1961 | Hennessey, Jr. et al. | 439/314 |
| 3,107,950 | 10/1963 | Kleven | 308/36 |
| 3,311,431 | 3/1967 | Hilliard | 308/189 |
| 3,359,047 | 12/1967 | Andersen | 308/36 |
| 4,110,716 | 8/1978 | Nikitas | 439/583 |
| 4,360,245 | 11/1982 | Nikitas | 439/736 |
| 4,688,877 | 8/1987 | Dreyer | 439/584 |

*Primary Examiner*—Gary F. Paumen

*Attorney, Agent, or Firm*—Wolf, Greenfield & Sacks

[57] ABSTRACT

An electrical connector having inner and outer conductors along with a sleeve therebetween. The outer conductor has an inwardly directed annular ridge adapted to interlock with an annular recess in the sleeve. In order to maintain contact between the recess of the sleeve and the annular ridge of the outer conductor with changes in temperature, the length of the ridge is related to the diameter of the sleeve at each point along the slope of the beveled wall of the ridge by the equation $L = D \tan \theta$. In a second version of the invention described herein there is an assymetrical connector in which the opposed beveled end walls of the respective body and sleeve are defined by frusto-conic surfaces of cones each having a common vertex preferably disposed on the connector longitudinal axis.

34 Claims, 9 Drawing Sheets

$L2' = L1' \times b \times \Delta T \quad D2' = D1' \times b \times \Delta T$

ELECTRICAL CONNECTOR

RELATED APPLICATION

This application is a continuation in part of application of Ser. No. 864,739, filed May 13, 1986 (now U.S. Pat. No. 4,775,325), which in turn is a file wrapper continuation application of Ser. No. 729,642, filed May 2, 1985, now abandoned, which in turn is a continuation-in-part of Ser. No. 610,268, filed May 14, 1984, now abandoned, which in turn is a continuation-in-part of application Ser. No. 579,404, filed Feb. 13, 1984 now abandoned.

BACKGROUND OF THE INVENTION

1. Field of the Invention

The present invention relates in general to an electrical connector which may be of the jack-to-jack or barrel connector type including a center conductor, outer conductor, and separating insulating sleeve. More particularly, the present invention relates to an improvement in connectors of this general type so that the connector is mechanically tight. In accordance with the improved connector of the invention, compensation is made for connector part shrinkage so as to maintain a mechanically tight seal over an extended temperature range.

2. Background Discussion and Objects of the Invention

The above identified and related U.S. application Ser. No. 864,739, filed May 13, 1986 describes an improved mechanically tight connector of symmetrical construction.

It is an object of the present invention to also provide an improved coaxial-type connector in which the connector is characterized by having an improved mechanically tight seal.

Another object of the present invention is to provide an improved coaxial connector in which the connector inner and outer conductor parts are maintained in a rigid mechanical interconnecting relationship.

Still a further object of the present invention is to provide an improved method of assembly that is carried out quite easily with few steps.

Another object of the present invention is to provide an improved electrical coaxial connector and associated method of making of the connector in which the connector is made without degrading the electrical characteristics associated with the lines intercoupled by the connector.

A further object of the present invention is to provide an improved coaxial connector design, and one in which the inner and outer conductors are mechanically tightly positioned relative to each other and are maintained in that position in use over a wide temperature range.

Still another object of the present invention is to provide an improved electrical coaxial connector that may be constructed in either symmetric or assymetric form.

SUMMARY OF THE INVENTION

To accomplish the foregoing and other objects of the invention, there is now described herein an electrical connector that may be constructed in accordance with two separate principles described herein. In accordance with a first version of the invention, the electrical connector is comprised of an outer conductor body, an inner conductor adapted to fit within the body and an insulating sleeve adapted to intercouple between the body and the center conductor. In an embodiment disclosed herein, the connector is of the type in which the center conductor may be attached to a circuit or circuit board. In accordance with a preferred method of assembly of the connector, the sleeve is assembled into the body before the center conductor is assembled into the sleeve. The body is provided with an annular ridge so as to snugly receive the sleeve. The outer conductor and the inner conductor are then sealed as a unit and heat is applied at a temperature in excess of the maximum operating temperature corresponding preferably to the rated specification for the connector. For some applications, it may also be possible to mate the parts without requiring heat for the mating of parts. When heat is applied, the sleeve, which is preferably of Teflon, swells to fill any cavities and has cold flow properties that enable it to retain its shape even after the temperature cools. In accordance with this version of the invention, the aforementioned annular ridge is adapted to have a length that relates to the diameter of the sleeve. If the length is L, and the diameter is D, then the following equation applies, $L=D \tan \theta$. This equation has been derived in accordance with the present invention and provides a relationship for maintaining proper sealing contact to provide a mechanically tight fit. In the foregoing equation, the angle $\theta$ represents the end angle of the ridge. In a preferred embodiment, wherein the angle $\theta=45°$, then from the above equation, this means that the construction is selected so that the length of the ridge is substantially the same as the diameter of the sleeve which in turn is comparable to the inner diameter of the outer conductor body.

In accordance with a further version of the present invention, identified herein as an asymmetrical, there is provided an electrical connector that is comprised of an outer conductor connector body having a center bore with there being defined in the center bore a inwardly directed annular ridge extending into the bore. The connector also includes a sleeve disposed in the outer conductor body bore and adapted to mate substantially therewith and including means forming an annular recess that interlocks with the annular ridge. An inner conductor is adapted to be fitted within the sleeve. The annular ridge has at opposite ends thereof beveled end walls transitioning between the outer conductor body bore and the annular ridge. Similarly, the annular recess has, at opposite ends thereof, recess-defining beveled end walls transitioning between the outer diameter of the sleeve and the inner diameter of the sleeve at the annular recess.

The beveled end walls of both the ridge and recess are in contact. A clearance is provided between the insulating sleeve and outer conductor so as to enable temperature expansion between the parts. However, the actual contact between the sleeve and outer conductor is only at the beveled surfaces which always stay in intimate but relative sliding contact over temperature ranges. The opposed beveled end walls of respective body and sleeve lie on the surfaces of cones which each have a common vertex that is usually, but not necessarily disposed on the connector axis. The connector body annular ridge as well as the sleeve annular recess each have a gradual varying length progressing circumferentially about the respective body and sleeve.

BRIEF DESCRIPTION OF THE DRAWINGS

Numerous other objects, features, and advantages of the invention should now become apparent upon a reading of the following detailed description taken in conjunction with the accompanying drawings, in which.

DETAILED DESCRIPTION

Figure 1:
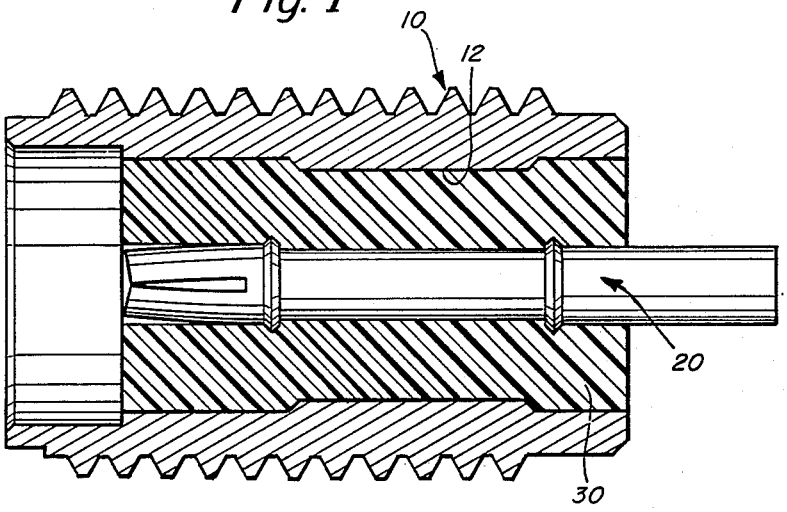
FIG. 1 is a cross-sectional view of a connector constructed in accordance with one version of the present invention.

FIG. 1 is a cross-sectional view of a connector embodying the principles of the present invention. The connector illustrated in FIG. 1 may be for connection to a printed circuit board although it also has other applications. The concepts of the present invention may be employed in connection with the making of any type of connector in which inner and outer conductors are to be relatively supported. For example, the principles of the invention may be applied in constructing connectors such as of the general type illustrated in my aforementioned application Ser. No. 579,404.

Figure 5:
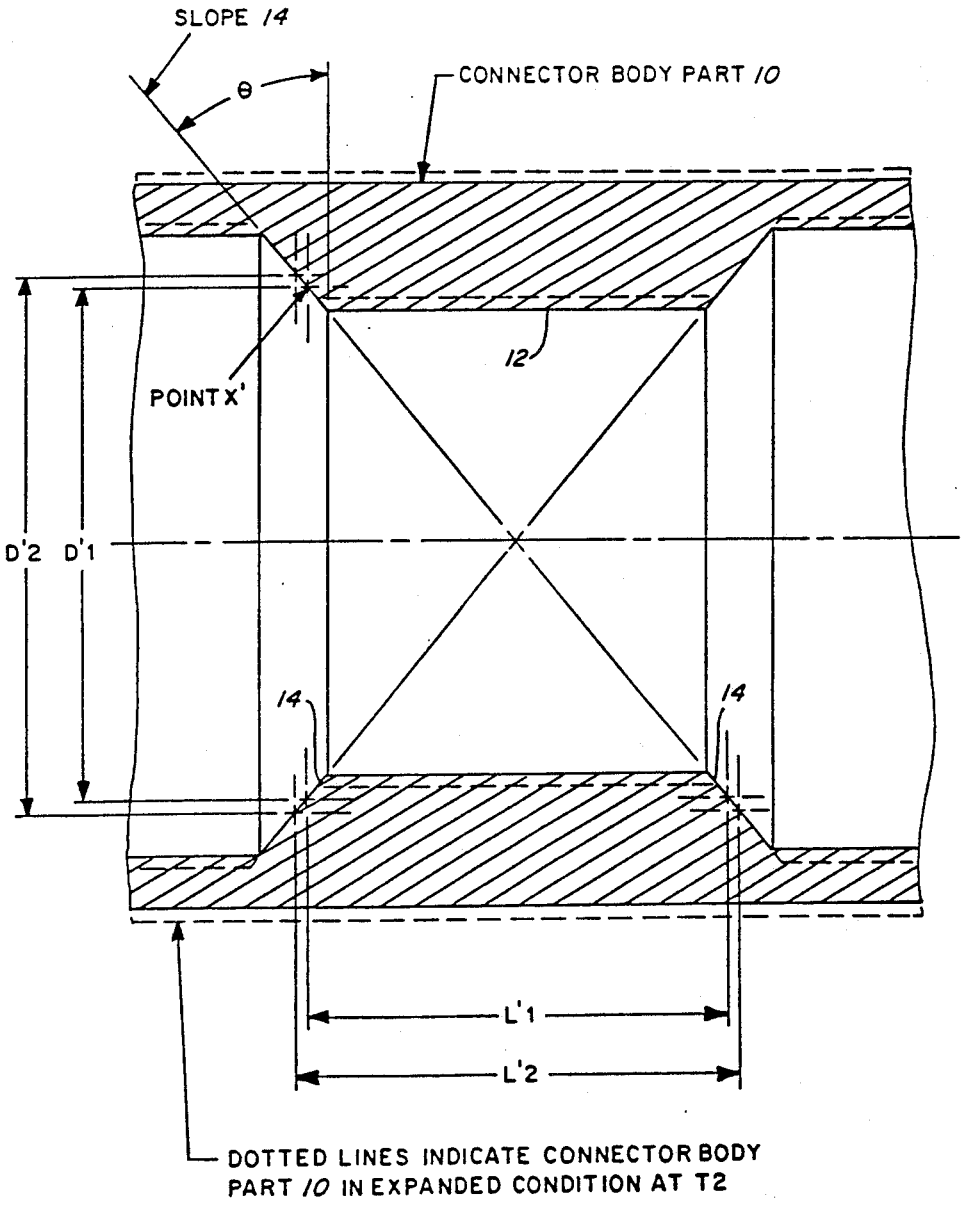

The connector illustrated in FIG. 1 comprises a connector body 10 forming an outer conductor, an inner conductor 20 and a Teflon sleeve 30. Teflon has good cold flow properties which enable it to be heated to conform to the shape of the inner and outer conductors. FIG. 1 illustrates the Teflon sleeve in its final shape. Initially, the Teflon sleeve may be of the size and shape as illustrated in FIG. 5 of application Ser. No. 579,404.

Briefly, in accordance with the method of manufacture, the Teflon sleeve 30 is assembled into the body 10 so that it extends along the bore length of the body. The bore length may be substantially the same length as the length of the Teflon sleeve and may also be the same as the length of the center conductor. The next step is assembling of the center conductor into the Teflon sleeve while at the same time maintaining the Teflon sleeve in place in the outer conductor. The assembly operations occur without the application of any heat.

Reference may also now be made to Ser. No. 864,739 referred to hereinbefore in which the subsequent steps of manufacture include plugging the ends of the connector, and applying heat. The connector is heated to a maximum temperature which preferably exceeds the rated specification for the connector. The preferred temperature for heating is on the order of 165° C. Cold flow is faster at this temperature. The Teflon is a good insulator and also has good cold flow characteristics allowing expansion thereof as the heat is applied.

When the Teflon sleeve 30 is first inserted, because of the existence of the ridge 12, there may be a small gap between the sleeve and the inner bore of the outer conductor 10 at positions other than where the ridge occurs. However, when the heating occurs, the Teflon expands and fills this void and is essentially interlocked about the inwardly directed annular ridge or ring 12. FIG. 1 illustrates the Teflon having been heated and expanded to essentially fill and match the contour of the inner bore of the outer conductor 10. Also, with respect to the center conductor 20, the Teflon expands about the center conductor and in particular expands into the annular channels that are provided in the center conductor. Thus, the Teflon experiences expansion toward the outer conductor to interlock with the ridge 12 and also experiences inward expansion to interlock with the center conductor and thus provide an overall interlocking between the inner and outer conductors.

Figure 2:
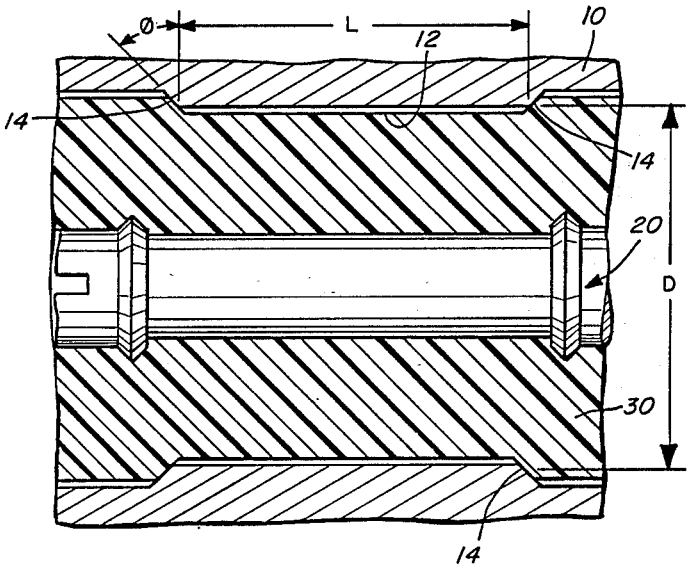
FIG. 2 is a somewhat enlarged fragmentary view of a part of the connector illustrated in FIG. 1.
Figure 3:
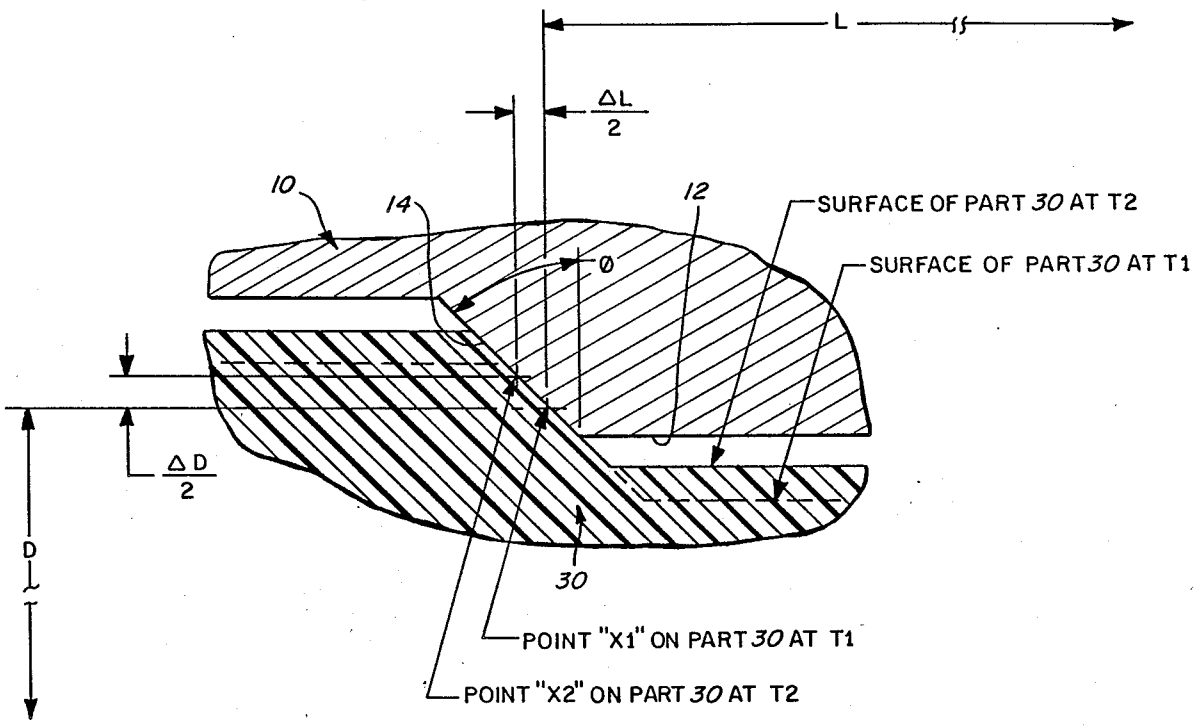
FIG. 3 is still a further fragmentary view showing connector part dimensional relationships at different temperatures.

FIGS. 2 and 3 are enlarged fragmentary views of a portion of the connector shown in FIG. 1. These fragmentary views are instrumental in explaining the principles of the present invention as they relate to certain dimensional parameters that are set forth.

Figure 6:
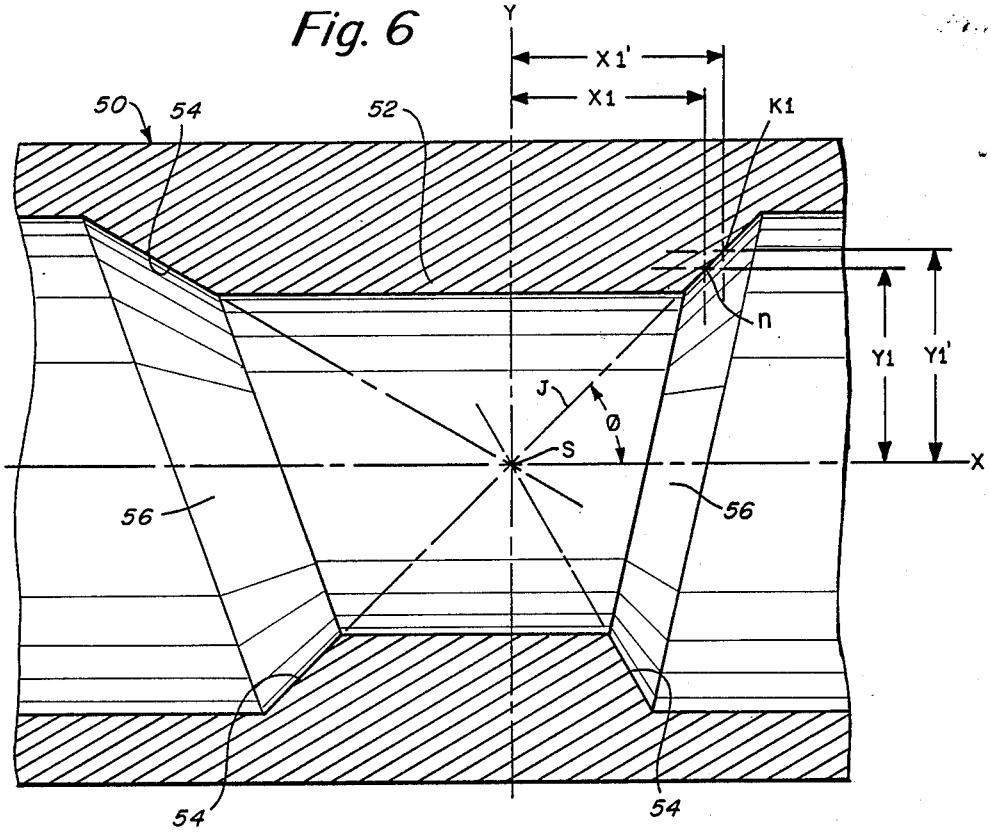
FIG. 6 is a cross-sectional view of a second version of the present invention in which the connector is referred to as an assymetrical connector, illustrating in particular the outer connector body.

In application Ser. No. 579,404, it is noted that the ridge 14 such as illustrated in FIG. 6 therein was of a relatively short dimension lengthwise and when shrinkage occurred, this did provide for some interlocking but did not provide a mechanically tight seal particularly over any significant temperature range of operation. However, now in accordance with the principles of this invention, there is provided a relationship between the mean diameter of the sleeve and the length of the ridge so as to maintain contact between the sleeve and outer conductor even though shrinkage occurs, and to maintain this contact sufficiently so as to provide a mechanically tight seal.

Thus, in connection with FIGS. 2 and 3, there is provided a fragmentary view illustrating, in particular, the area of the connector at the annular ridge 12 of the outer conductor 10. Between the views of FIGS. 2 and 3 there is illustrated important dimensions including the length L of the ridge 12 and the diameter D which is the mean diameter of the sleeve 30. The drawing also shows the angle $\theta$ which is the angle on the beveled end 14 of the ridge 12.

FIG. 3, in particular, is an expanded fragmentary view of the end of annular ridge 12, showing the changes of part 30 relative to part 10 with a change in temperature. In FIG. 3 the part 10 is considered stationary for the sake of the following derivations. Note that the part 30 is shown in solid in connection with its position relating to temperature $T_2$ and is shown in dotted with relationship to its position in connection with temperature $T_1$.

For materials commonly used in high frequency electrical connectors, the outer conductor or part 10 is normally metallic while the inner sleeve or part 30 is an insulator, normally plastic. Most metals have a much lower coefficient of expansion than plastics and thus the following derivation and the geometries of the drawing illustrate that particular case, although, the concepts of the invention will also apply for other combinations of materials including those in which the outer part has a higher coefficient of expansion than the inner part.

Figure 4:
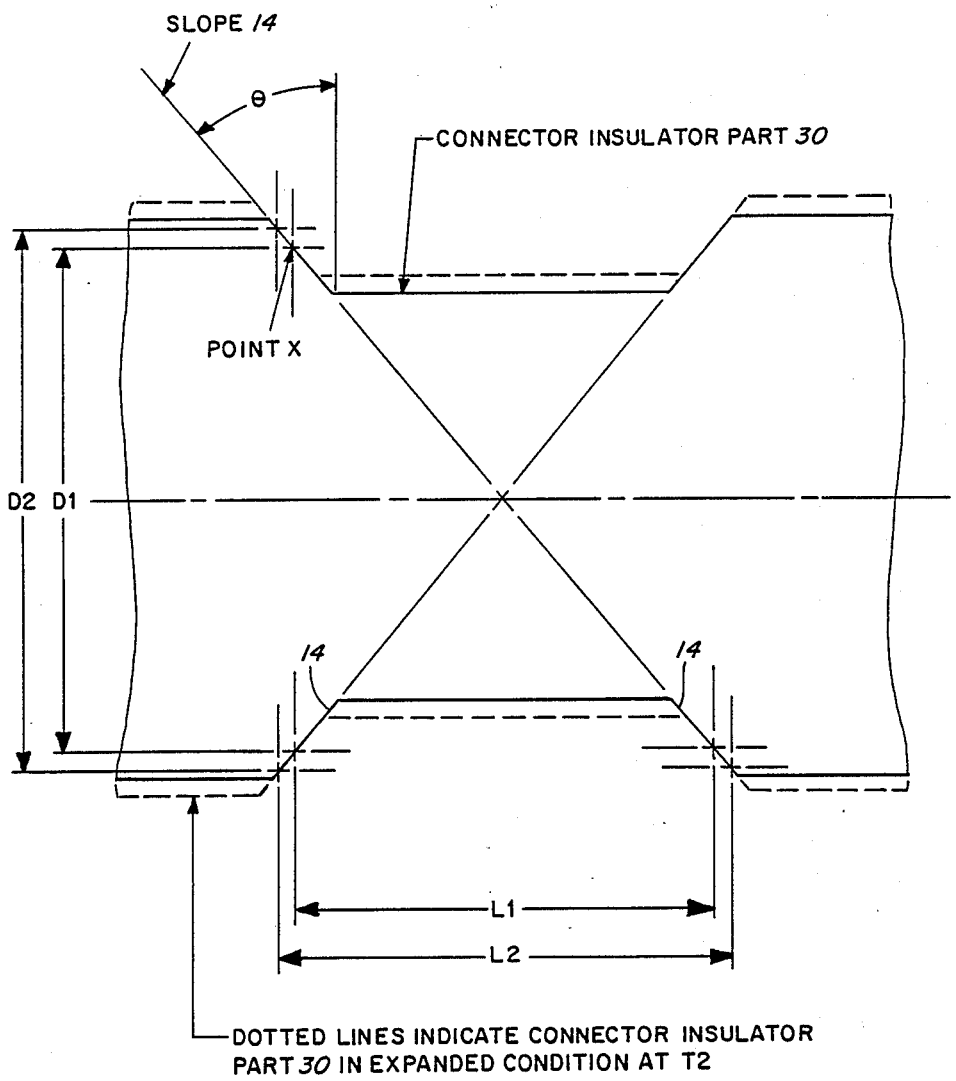
FIGS. 4 and 5 are partial schematic views used to illustrate the relative movement between the beveled end walls of the connector body and sleeve during a change in temperature.

The parts of a connector fabricated in accordance with the present invention maintain mechanical contact and a tight fit over a wide range of temperatures. The connector includes a connector body comprising an outer conductor having an axially symmetrical bore with an internal ridge of axial length L and diameter D as shown in FIG. 5. The internal ridge is beveled at an angle $\theta$ at each end, wherein $\theta$ is measured with respect to a plane perpendicular to the axis of the bore. A connector insulator having a groove complementary with the internal ridge in the connector body and beveled at an angle $\theta$ at each end is positioned in the bore as shown in FIG. 4. When the connector is assembled, the insulator is positioned in the bore of the connector body with the internal ridge of the connector body interengaged with the groove in the insulator. In accordance with the principals of the present invention, the internal ridge and the groove are fabricated so that $L/D=\tan\theta$. The following analysis proves that when this relationship is maintained, the connector body and the connector insulator will remain in contact along the beveled ends of the internal ridge and the groove. In the following derivations, it is noted that one is assuming work with isotropic materials.

With reference to insulator part 30 shown in FIG. 4, as the temperature changes from $T_1$ to $T_2$, a point x on the beveled end of the groove moves from the point defined by $L_1$, $D_1$ to the point defined by $L_2$, $D_2$ due to expansion of the part 30. The change in location of point x in the radial direction, $\Delta D$, is given by:

$$\Delta D=D_1.a.\Delta T \tag{6}$$

where $D_1$=diameter of part 30 at the point x a=coefficient of expansion of part 30

$\Delta T$=change in temperature=$T_2-T_1$

Similarly, the change in location of point x in the axial direction, $\Delta L$, is given by $$\Delta L=L_1.a.\Delta T \tag{7}$$

where $L_1$=length of internal ridge at point x

A line drawn through point x at $T_1$ and point x at $T_2$ is inclined at an angle $\theta$ with respect to vertical. By trigonometric definition:

$$\tan\theta = \Delta L/\Delta D = \frac{L_1 \cdot a \cdot \Delta T}{D_1 \cdot a \cdot \Delta T} = \frac{L_1}{D_1} \tag{8}$$

From equation (8), it can be seen that $\theta$, which defines the line along which point x moves, equals $\phi$, the angle of the beveled groove end only when $\tan\phi=L/D$. This means that the two lines are congruent, and point x moves in the direction of the beveled end surface during thermal expansion and contraction.

A similar analysis is applied to connector body part 10 shown in FIG. 5. As the temperature changes from $T_1$ to $T_2$, a point x' on the beveled end of the internal ridge moves from the point defined by $L_1'$, $D_1'$ to the point defined by $L_2'$, $D_2'$, due to the expansion of part 10 The change in the location of point x' in the radial direction, $\Delta D'$, is given by:

$$\Delta D'=D_1'.b.\Delta T \tag{9}$$

where $D_1'$=diameter of part 10 at point x' b=the coefficient of expansion of part 10.

Similarly, the change in location of point x' in the axial direction, $\Delta L'$, is given by:

$$\Delta L'=L_1'.b.\Delta T \tag{10}$$

where $L_1'$=length of groove at point x'

A line drawn through point x' at $T_1$ and through point x' at $T_2$, is inclined at an angle $\theta'$ with respect to vertical. By trigonometric definition:

$$\tan\theta' = \Delta L'/\Delta D' = \frac{L_1' \cdot a \cdot \Delta T}{D_1' \cdot a \cdot \Delta T} = \frac{L_1'}{D_1'} \tag{11}$$

From equation (11), it can be seen that $\theta'$, which defines the line along which point x' moves, equals $\phi$, the angle of the beveled ridge end, only when $\tan\phi=L/D$. This means that the two lines are congruent, and point x moves in the direction of the beveled end surface during thermal expansion and contraction. When connector body part 10 and connector insulator part 30 are assembled together so that $D_1=D_2'$ and $L_1=L_1'$, both part 10 and part 30 move in the direction of the line defined by $\phi$ during thermal expansion and contraction. The parts remain in contact along the beveled ends of the ridge and groove, even though they slide relative to each other due to differing coefficients of expansion. Again, the above derivations assume the use of isotropic materials.

The above proof can be interpreted as follows. When the parts are constructed so that $L/D=\tan\phi$, lines drawn through the beveled ends of the ridge and the beveled ends of the groove intersect at a common point P on the axis of the parts and at the mid-points of the ridge and the groove. If the point P is considered as the center of expansion for each part, then thermal expansion causes radial movement of any arbitrary point in the part with respect to the center of expansion. Points on the beveled ends of the ridge and the groove move radially in the direction of the beveled ends during a temperature change and thereby remain on the same radial line. This holds true for both parts, constructed of isotropic materials, regardless of differing coefficients of expansion. The important result is that the parts remain in contact at the beveled ends of the internal ridge and the groove and simply slide relative to each other over these angled surfaces during a temperature change, as illustrated in FIG. 3. Therefore, the parts remain in contact on these angled surfaces even though they do not remain in contact move their nonangled portions due to the differing coefficients of expansion. The connector thereby maintains mechanical contact and tight fit between parts over a temperature range in spite of differing coefficients of expansion.

Figure 7:
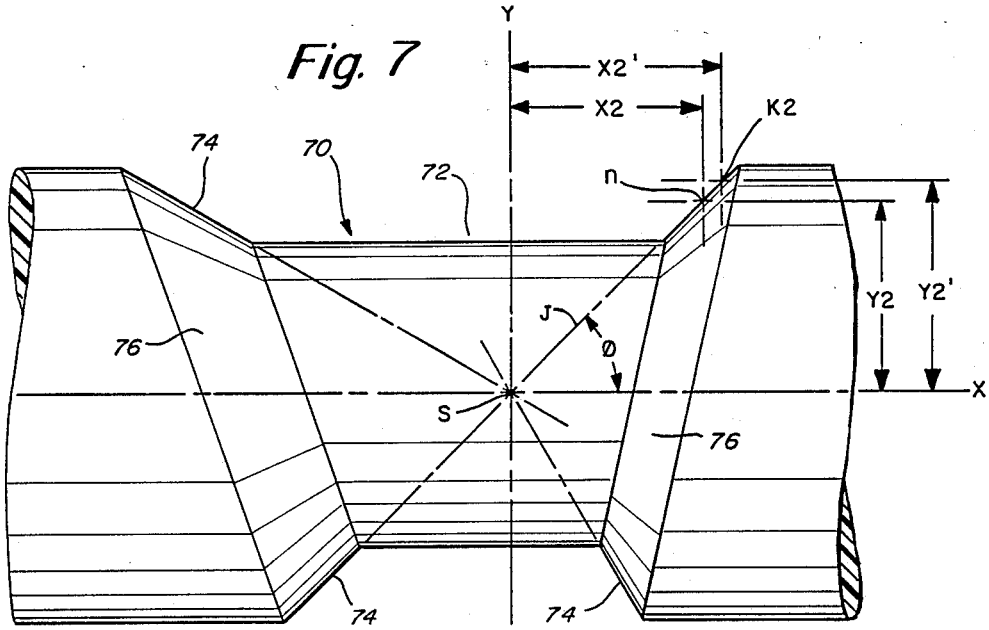
FIG. 7 is a side elevation view illustrating the construction of the sleeve used with the outer conductor body of FIG. 6.
Figure 8:
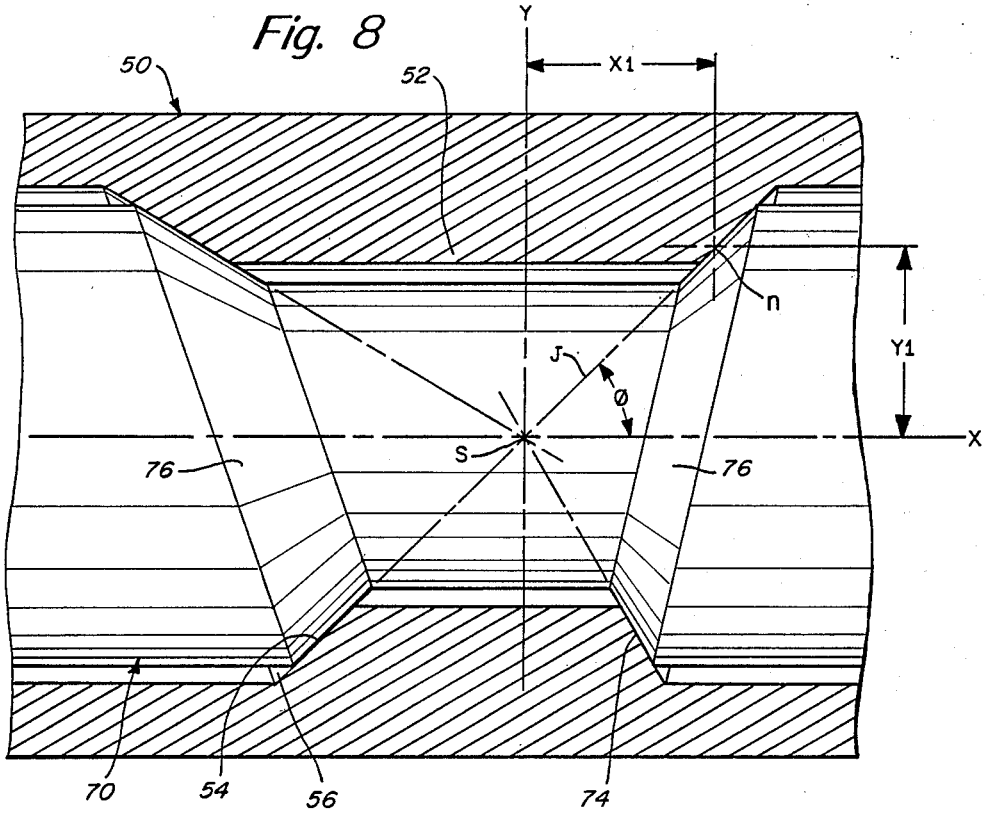
FIG. 8 is a cross-sectional view of the outer conductor body along with the sleeve in an assembled position as in accordance with the version of FIGS. 6 and 7.
Figure 9:
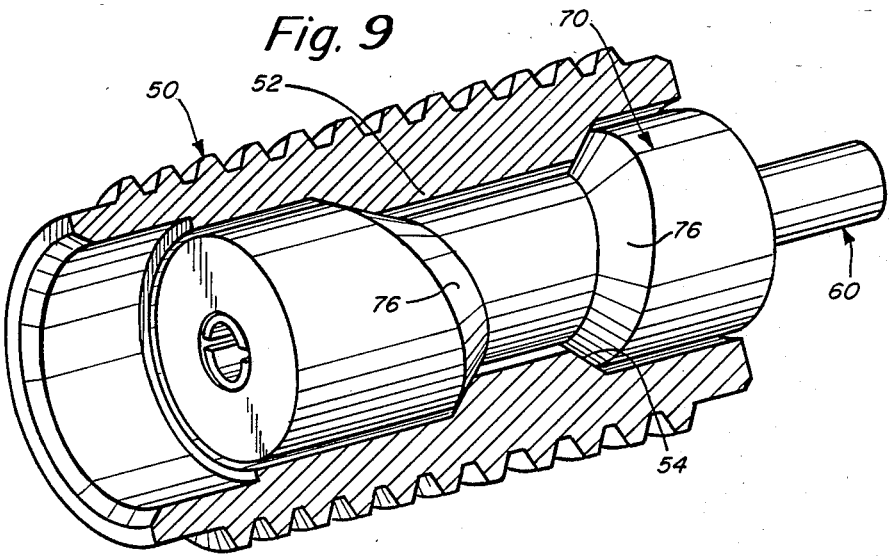
FIG. 9 is a cutaway perspective view of the connector illustrated in FIGS. 6–9.

Reference is now made to the asymmetrical version of the present invention as illustrated in FIGS. 6–9. FIGS. 6 and 7 illustrate the body and sleeve. FIG. 8 illustrates these members in an interlock state. FIG. 9 is a cross-sectional perspective view showing the connector along with the inner conductor. This particular connector design is referred to as an asymmetrical design because the beveled end walls defining the ridge and recess are formed from frusto-conic surfaces of an oblique cone. In comparison, the beveled end wall surfaces in the version illustrated in FIGS. 1–5 are formed from frusto-conic surfaces of a right cone. Actually, a further asymmetric version is illustrated hereinafter in FIG. 12 in which the frusto-conic surface is also of a right cone. Note that in all such embodiments the opposed cone surfaces (as represented by elements on the surface thereof) intersect at a single common vertex. In other words the frusto-conic surfaces lie on cones having a common vertex.

The connector illustrated in FIGS. 6–9 is comprised of a connector body 50 forming an outer conductor, an inner conductor 60 and a Teflon sleeve 70. Teflon has good cold flow properties which enable it to be heated to conform to the shape of the inner and outer conductors. FIG. 8 illustrates the Teflon sleeve in its final position interlocked in the outer conductor. Initially, the Teflon sleeve may be fabricated of smaller sized than illustrated and then heated. In this connection, because of the asymmetrical nature of the construction as illustrated in FIGS. 6–9, the outer conductor and sleeve are aligned circumferentially relative to each other so that there is substantially only one proper alignment position so that the proper length recess interlocks with the proper length ridge. The respective parts may be marked for the purpose of providing this circumferential relative alignment Briefly, in accordance with one method of assembly, the Teflon sleeve 70 is assembled into the body 50 so that it extends along the bore length of the body. The connector is then heated to a maximum temperature which exceeds the specification for the connector. The preferred temperature for heating may be in the order of 160° C. Cold flow is faster at this temperature. The Teflon is a good insulator and also has good cold flow characteristics allowing expansion thereof as the heat is applied.

When the Teflon sleeve 70 is first inserted, because of the existence of the ridge 52, there may be a small gap between the sleeve and the inner bore of the outer conductor 50 at positions other than where the ridge occurs. However, when the heating occurs, the Teflon expands and fills this void and is essentially interlocked about the inwardly directed annular ridge 52, as is illustrated in FIG. 8. FIG. 8 illustrates the Teflon having been heated and expanded to partially fill and match the contour of the inner bore of the outer conductor 50. There is illustrated a gap in FIG. 8. As noted in FIG. 8 the contact surface is at the beveled walls and this is where the mechanical tightness occurs. The gap at remaining areas allows for expansion and contraction but at the beveled walls relative part sliding occurs while always maintaining tight mechanical interlocking over substantial temperature ranges.

Figure 10:
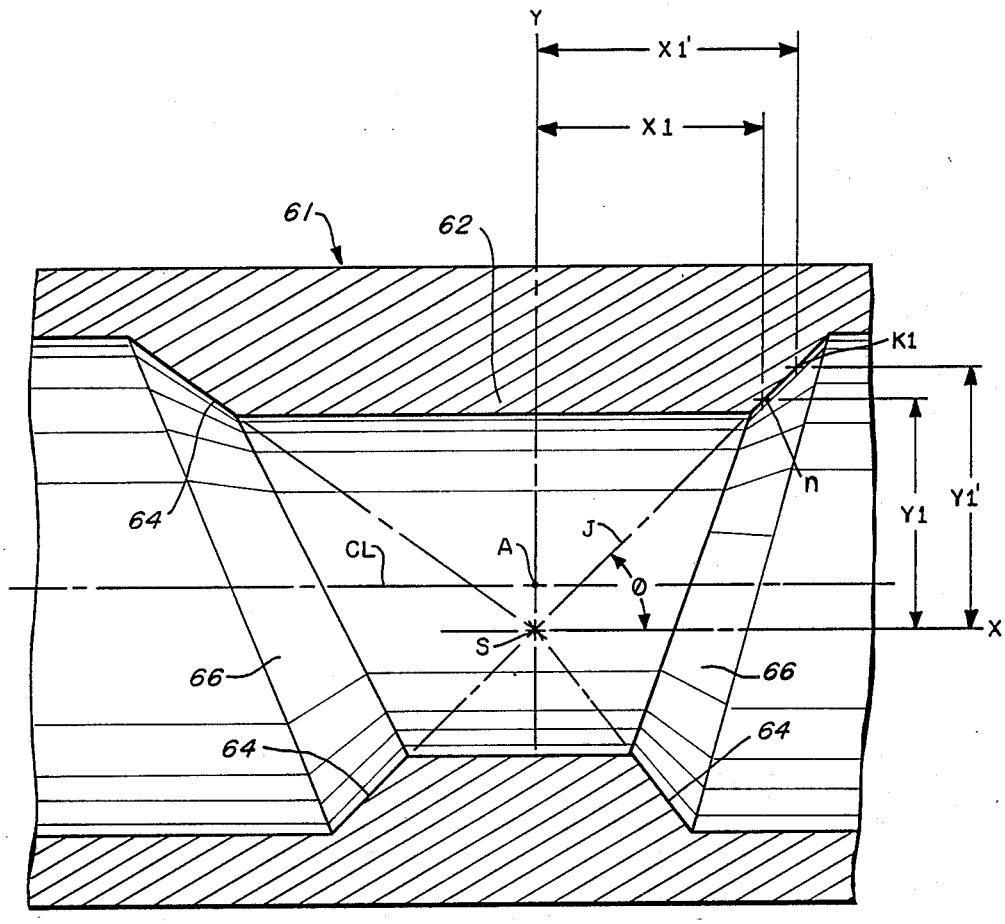
FIG. 10 is a cross-sectional view of the outer conductor body for another embodiment of the invention in which the cone apex is off the center line of the body.

Reference is now made to the cross-sectional view of FIG. 6. This illustrates the outer conductor body 50 with its annular ridge 52 defined by opposed beveled end walls 54. These beveled end walls are defined by a frusto-conic surface as indicated at 56 in FIG. 6. These are respective frusto-conic surfaces of oblique cones having a common vertex as illustrated at S in FIG. 6. Reference will be made hereinafter to FIG. 10 in which oblique cones are also illustrated but in which the vertex is off of the center line of the parts. In still a further asymmetric version in FIG. 12, the frusto-conic surface is of a right cone.

FIG. 7 now illustrates the Teflon sleeve 70 having a recess as indicated at 72 in FIG. 7. This recess is similarly defined by opposed beveled end walls 74. These end walls define a frusto-conic surface illustrated at 76 in FIG. 7. These opposed frusto-conic surfaces are formed from oblique cones each having a common vertex also at the same center point, namely vertex S in FIG. 7.

Now, in accordance with this version of the invention, there is provided a derivation to follow that indicates that the parts, and in particular the outer conductor and the sleeve are formed in a manner so as to maintain contact between the sleeve and outer conductor even though shrinkage occurs, and to maintain this contact sufficiently so as to provide a mechanically tight seal while maintaining a solid mechanical connection between the connector parts.

For materials commonly used in high frequency electrical connectors, the outer conductor or part 50 is normally metallic while the inner sleeve or part 70 is an insulator, normally plastic or Teflon. Both of these materials are typical of isotropic materials. Most metals have a much lower coefficient of expansion than plastics and thus the following derivation and the geometries of the drawing illustrate that particular case, although the concepts of the invention also apply for other combinations of materials including those in which the outer part has a higher coefficient of expansion than the inner part.

In FIG. 6, the outer conductor 50 may be considered as having three inner cylindrical bores connected by the two conical surfaces illustrated in FIG. 6 as frusto-conic surfaces 56. When these surfaces are extended, they contain a common vertex, namely point S in FIG. 6. This represents the apex or vertex of each of these cones.

Similarly, FIG. 7 illustrates the sleeve 70 which is comprised of essentially three cylinders connected by two conical surfaces, illustrated in FIG. 7 as the frusto-conic surfaces 76. It is noted that these surfaces may be extended to a common point, namely point S in FIG. 7. This is the apex or vertex of the common cones. These cones illustrated in FIGS. 6 and 7 are cones having their vertex at this common point S.

As illustrated in FIG. 8, the outer diameter of the cylinders comprising sleeve 50 have a smaller diameter than the corresponding cylindrical bores of the outer conductor 50. Thus, the two separate parts, namely the outer conductor 50 and the sleeve 70 are supported substantially only on these conical surfaces, namely the conical surface 56 of the outer conductor 50 and the conical surface 76 of the sleeve 70.

With respect to the embodiment of FIGS. 6–8, the following parameters are established:

a = coefficient of expansion of outer conductor 50 b = coefficient of expansion of sleeve 70

$t_1$ = initial temperature $t_2$ = final temperature

In FIGS. 6–8, an arbitrary element of the cone 76, referred to as element J, is selected. It passes through the point S by definition. One may then select an arbitrary line through point S which may be referred to as line SX. The line SX need not be coincident with the axis of the internal cylinder defining the outer conductor, although, in practice, that is usually the case and is preferred. The plane containing the two intersecting lines J and SX is denoted by JSX. It is this plane, JSX, that is illustrated in FIGS. 6–8.

The line SY is defined as the line perpendicular to the line SX and through the point S in the JSX plane. Clearly, the lines SX and SY can be considered to be the X and Y axis of the plane JSX. Every element of the cone 56 has such a coordinate system associated with it so that whatever is proved for one element of the cone is proven for every other.

Also illustrated in the drawings is the angle $\phi$ which is illustrated as the angle between the X axis and the previously selected element of the cone, namely element J. An element of a cone is defined in geometry as a straight line on the conical surface of the cone passing through the vertex.

The X dimension is a length dimension illustrated in the drawings as measured from the Y axis to a point n on the cone element J. This point coincides with a point on both conical surfaces of the outer conductor and the sleeve. In FIG. 6 the dimension is illustrated as length $X_1$ relating to the outer conductor while in FIG. 7 this dimension is expressed as dimension $X_2$ relating to the sleeve.

Associated with the X dimension, is a Y dimension also illustrated in the drawings The Y dimension is the distance from the point n on the conical surface measured perpendicular to the X axis. In FIG. 6 this dimension is indicated as dimension $Y_1$ associated with the outer conductor. In FIG. 7 this dimension is dimension $Y_2$ associated with the sleeve 70.

The general equation for a straight line in geometry is $Y=MX+C$ where M is the slope of the line and C is the intersection with the Y axis. Now, one can assume that the common apex of the conic surfaces as illustrated in the drawings, coincides with the origin of the coordinate system. Then, the slope of an element passing through point n is $Y_1/X_1$, and the equation for the element through point n is $Y = Y_1/X_1.X$.

In FIG. 6 when the temperature of the outer conductor 50 changes from temperature $t_1$ to $t_2$, for an isotropic material, the following relationships apply:

$$X_1'=X_1\,(t_2-t_1)a;\ Y_1'=Y_1\,(t_2-t_1)a$$

The slope, ml, of the line or conic element through points n and $K_1$ is represented by:

$$\frac{Y_1' - Y_1}{X_1' - X_1} = \frac{Y_1\,(t_2 - t_1)a - Y_1}{X_1\,(t_2 - t_1)a - X_1}$$

This equation may also be expressed as:

$$m_1(X_1(t_2-t_1)a-X_1)=Y_1(t_2-t_1)a-Y_1$$

This equation can then be reduced to the following:

$$m_1\,X_1 = Y_1,\ \text{or}\ m_1 = \frac{Y_1}{X_1} = \tan\phi$$

Thus, the lines joining points n and $K_1$ has the same slope as the line joining points S and n. Moreover, it coincides with the element of the cone passing through the point n since both lines lie on the same plane, have the same slope and pass through a common point.

Now, with regard to FIG. 7 the same argument just used also applies to the expansion or contraction of the sleeve. By using the previous derivation one can thus arrive at the following relationship:

$$\frac{Y_2}{X_2} = \tan\phi$$

The above equation applies whether derived from line Sn or the line $nK_1$.

The above derivations indicate that a point on a conic surface remains on the original element of the conic surface throughout any expansion or contraction changes due to temperature changes. Thus, when two parts with unequal coefficients of expansion are assembled with mating conic surfaces as shown in FIG. 8, as long as the two conic surfaces have a common vertex and the materials used are isotropic, the parts retain the original assembly configuration without the joints tightening or loosening throughout temperature changes. In accordance with the principles of this invention as embodied in FIGS. 6–8, the parts, namely the outer conductor 50 and the sleeve 70 slide along these conic surfaces (beveled end walls) to maintain contact between these parts over expansion and contraction of the parts due to temperature changes over a temperature range. In this connection it is noted in the above derivation that the portions of the equations relating to coefficient of expansion cancel out clearly indicating that the relative coefficient of expansion thus ultimately do not have any effect upon the looseness or tightness of coupling of the parts.

Figure 11:
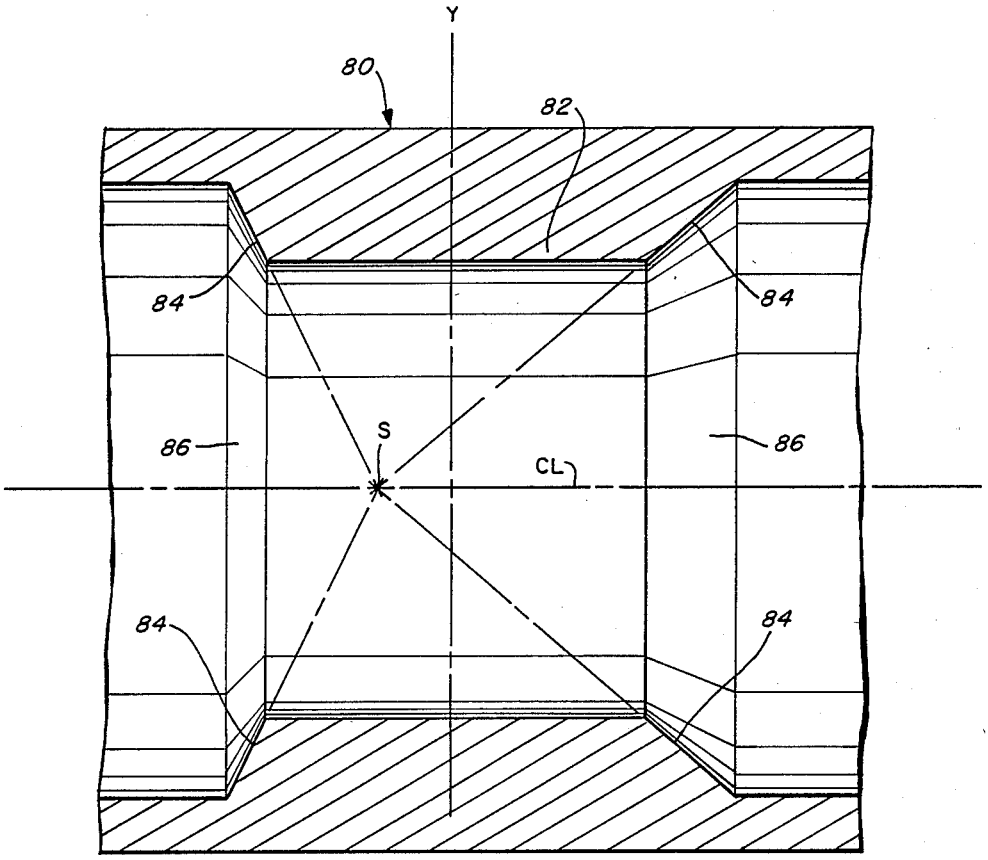
FIG. 11 is a cross-sectional view of the outer conductor body for still a further embodiment of the invention.
Figure 12:
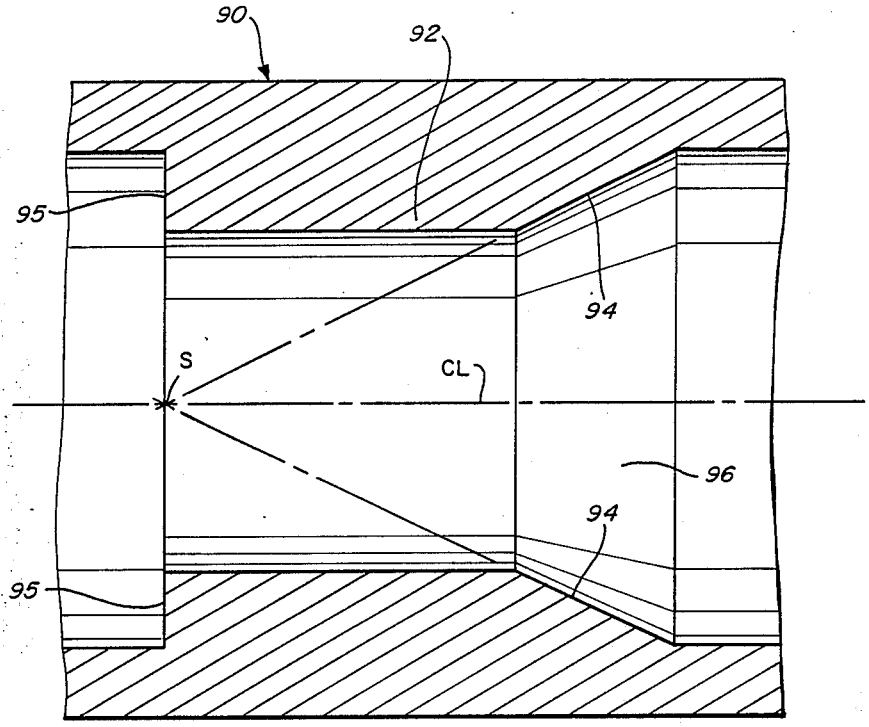
FIG. 12 is a cross-sectional view of the outer conductor body for still another version of the present invention in which one of the cones is a plane.

Reference is now made to further embodiments of the invention illustrated in FIGS. 10–12. These further embodiments of the invention are illustrated for the purpose of showing the various embodiments that are contemplated as falling within the scope of the invention. In FIGS. 10–12 only the outer conductor is illustrated, it being understood that a corresponding sleeve is provided mating in a manner with the outer conductor body as has been previously illustrated in FIG. 8.

In the embodiment of FIGS. 6–8, it is noted that the apex of the cones falls upon the center line of the parts. FIG. 10 has been illustrated to show that the apex of the cone, illustrated in FIG. 10 at S need not fall upon the center line CL of the connector outer conductor.

In FIG. 10 there is illustrated the outer conductor body 61 with its annular ridge 62 defined by opposed beveled end walls 64. These beveled end walls are defined by a frusto-conic surface as illustrated at 66 in FIG. 10. These are respective frusto-conic surfaces of oblique cones having a common vertex at S. FIG. 10 also illustrates the point A on the center line CL falling on the Y axis. It is noted that the vertex of the cones at point S does not coincide with point A and does not fall upon the defined center line axis CL.

In the embodiment of the invention illustrated in FIG. 10, as well as in the embodiments of FIGS. 11 and 12, the same derivations, previously discussed in association with FIGS. 6–9, also supply to these further embodiments. For the sake of simplicity, these derivations are not repeated herein. In describing FIGS. 10–12, and in particular in FIG. 10, it is noted that the X and Y dimensions, previously identified are also identified in, for example, FIG. 10.

FIG. 11 illustrates a further embodiment of the present invention in which the vertex S is disposed on the Y axis. In the embodiment of FIG. 11 both cones have the common vertex point a S and thus the equations previously developed in the derivations set forth hereinbefore also apply to the version of FIG. 11.

In FIG. 11 the outer conductor body 80 is illustrated with its annular ridge 82 defined by opposed beveled end walls 84. In this embodiment it is noted that the beveled end walls 84, for example, on the right in FIG. 11 are longer than the corresponding end walls 84 on the left. These beveled end walls are defined by a frusto-conic surface as illustrated at 86 in FIG. 11. Again, it is noted that the surface 86 on the right in FIG. 11 is larger than the surface 86 on the left. This has to do with the positioning of the vertex of the respective cones.

FIG. 12 illustrates still a further version of the present invention in which the point S has now been moved so as to essentially eliminate one of the cones leaving one of the end walls, namely end wall 95 not beveled but instead a right angle end wall. At the right end in the embodiment of FIG. 12 there is provided the conic surface. In this regard the ridge 92 is defined by the beveled wall 94 and the end wall 95. There is a frusto-conic surface as illustrated at 96 in FIG. 12. The embodiment of FIG. 12 illustrates, not an oblique cone as in FIGS. 10 and 11, but instead a right cone. If the apex S were off the center line CL then an embodiment is envisioned in which there is still only one cone but it would then be an oblique cone rather than a right cone.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. An electrical connector comprising: an outer conductor connector body having a center bore with there being defined in the center bore, an inwardly directed annular ridge extending into the bore, a sleeve in the outer conductor body bore and adapted to be mated substantially therewith forming an annular recess that interlocks with said annular ridge, and an inner conductor adapted to fit within said sleeve, said annular ridge having a length L and having at opposite sides thereof beveled end walls transitioning between the outer conductor body bore and annular ridge, the length L being measured in an axial direction between spaced symmetric points at said respective beveled end walls, said sleeve having a mean diameter D, the diameter D being measured in a normal direction to the connector axis between spaced symmetric points at either one of said respective beveled end walls, said annular recess also having a length of substantially L and having at opposite sides thereof recess defining beveled end walls transitioning between the outer diameter of the sleeve and the inner diameter of the sleeve, the beveled end walls of both said ridge and said recess being in contact and at the same angle $\theta$ measured from a plane normal to the connector axis to the beveled end wall, whereby, to maintain mechanically tight coupling and positioning between the outer conductor and sleeve, the length L is related to the diameter D and the angle $\theta$, irrespective of the relative coefficients of expansion of the connector body and sleeve, by the following equation:

$$L = D \tan \theta$$

whereby, during expansion and contraction, the relative movement between the beveled end walls of the connector body and sleeve is along the line defined by said equation.

2. An electrical connector as set forth in claim 1 wherein said center conductor has spaced annular ribs with each rib being substantially in line with one of said beveled end walls.

3. An electrical connector as set forth in claim 1 wherein the length of the annular ridge is comparable to the mean diameter of the sleeve in the case where the angle $\theta$ is on the order of 45°.

4. An electrical connector as set forth in claim 1 wherein the annular ridge has a trapezoidal cross section including the beveled end walls.

5. An electrical connector comprising; an outer conductor connector body having a center bore with there being defined in the center bore, an inwardly directed annular ridge extending into the bore, a sleeve in the outer conductor body bore and adapted to be mated substantially therewith and including means forming an annular recess that interlocks with said annular ridge, and an inner conductor adapted to fit within said sleeve, said annular ridge having at opposite ends thereof end walls transitioning between the outer conductor body bore and annular ridge, said annular recess having at opposite ends thereof recess-defining end walls transitioning between the outer diameter of the sleeve and the inner diameter of the sleeve at said annular recess, at least segments of the end walls of both said ridge and said recess being in contact, each said end wall of both said ridge and said recess defining a circumferential surface, the circumferential surfaces on at least one end of the ridge and recess being formed as a frusto-conic surface, and the circumferential surfaces on both ends of the ridge and recess converging in a direction so as to project to a common point.

6. An electrical connector as set forth in claim 5 wherein each of the circumferential surfaces on the other end of the ridge and recess is defined by a right angle end wall.

7. An electrical connector as set forth in claim 6 wherein each of the frusto-conic surfaces is a frusto-conic surface of an oblique cone.

8. An electrical connector as set forth in claim 6 wherein each of the frusto-conic surfaces is a frusto-conic surface of a right circular cone.

9. An electrical connector as set forth in claim 5 wherein each of the end walls are beveled to define frusto-conic surfaces and wherein the common point is a common vertex of the frusto-conic surfaces.

10. An electrical connector as set forth in claim 9 wherein the frusto-conic surfaces are each a frusto-conic surface of a right circular cone.

11. An electrical connector as set forth in claim 9 wherein the frusto-conic surfaces are each a frusto-conic surface of an oblique cone.

12. An electrical connector as set forth in claim 9 wherein each said frusto-conic surface has a planar base defining one edge of a said beveled end wall and extending at an acute angle to the connector axis.

13. An electrical connector as set forth in claim 12 wherein said connector body annular ridge has a gradual varying length progressing circumferentially about said body.

14. An electrical connector as set forth in claim 13 wherein said sleeve annular recess has a gradual varying length progressing circumferentially about said sleeve.

15. An electrical connector as set forth in claim 5 wherein said common point falls between said circumferential surfaces of said sides of said ridge and said recess.

16. An electrical connector as set forth in claim 15 wherein said common point falls on the connector's longitudinal axis.

17. An electrical connector as set forth in claim 15 wherein said common point is not on the connector's longitudinal axis.

18. An electrical connector as set forth on claim 5 wherein the ridge has said spaced circumferential surfaces on both ends thereof and the recess has said spaced circumferential surfaces on both end thereof.

19. An electrical connector as set forth in claim 18 wherein at least some of said circumferential surfaces extend at an acute angle to the connector's longitudinal axis.

20. An electrical connector comprising, an outer conductor connector body having a center bore, a sleeve in the outer conductor body bore and adapted to be mated substantially therewith, said body center bore and the outer circumference of said sleeve having therebetween interlocking means comprising spaced mating circumferential wall surfaces on both ends thereof, at least segments of said spaced wall surfaces of the outer conductor and the sleeve being in contact, each of the wall surfaces on at least one end of the interlocking means being formed as a frusto-conic surface, and the wall surfaces on both ends of the interlocking means converging in a direction so as to project to a common point.

21. An electrical connector as set forth in claim 20 wherein the wall surfaces at one end are each defined by a frusto-conic surface and each of the wall surfaces at the other end is a right angle end wall.

22. An electrical connector as s®t forth in claim 21 wherein each of the frusto-conic surfaces is a frusto-conic surface of an oblique cone.

23. An electrical Connector as set forth in claim 21 wherein each of the frusto-conic surfaces is a frusto-conic surface of a right circular cone.

24. An electrical connector as set forth in claim 20 wherein each of the end walls is beveled to define frusto-conic surfaces and wherein the common point is a common vertex of the frusto-conic surfaces.

25. An electrical connector as set forth in claim 24 wherein the frusto-conic surfaces are each a frusto-conic surface of a right circular cone.

26. An electrical connector as set forth in claim 24 wherein the frusto-conic surfaces are each a frusto-conic surface of an oblique cone.

27. An electrical connector as set forth in claim 24 wherein each said frusto-conic surface has a planar base defining one edge of a said beveled end wall and extending at an acute angle to the connector axis.

28. An electrical connector as set forth in claim 27 wherein said connector body annular ridge has a gradual varying length progressing circumferentially about said body.

29. An electrical connector as set forth in claim 28 wherein said sleeve annular recess has a gradual varying length progressing circumferentially about said sleeve.

30. An electrical connector as set forth in claim 20 wherein said common point falls between the wall surfaces of said ends of said interlocking means.

31. An electrical connector as set forth in claim 30 wherein said common point falls on the connector's longitudinal axis.

32. An electrical connector as set forth in claim 30 wherein the common point is not on the connector's longitudinal axis.

33. An electrical connector as set forth in claim 20 wherein the interlocking means has said spaced circumferential surfaces on both end thereof.

34. An electrical connector as set forth in claim 33 wherein at least some of the wall surfaces extend at an acute angle to the connector's longitudinal axis.

* * * * *